US005421466A

United States Patent [19]

Hsu

[11] Patent Number: 5,421,466

[45] Date of Patent: Jun. 6, 1995

[54] SELF-ADJUSTING STORAGE RACK

[76] Inventor: Jung-Hsiang Hsu, W. 177 Morningside Rd., Paramus, N.J. 07652

[21] Appl. No.: 145,523

[22] Filed: Nov. 4, 1993

[51] Int. Cl.[6] ..... A47F 5/00

[52] U.S. Cl. ..... 211/120; 211/175

[58] Field of Search ..... 211/120, 69.8, 175, 211/69.1

[56] References Cited

U.S. PATENT DOCUMENTS

| | | | |
|---|---|---|---|
| 1,205,747 | 11/1916 | Kawate | 211/120 X |
| 1,682,060 | 8/1928 | Banks . | |
| 1,739,545 | 12/1929 | Cubberley . | |
| 1,750,576 | 3/1930 | Cubberley . | |
| 1,772,438 | 8/1930 | Cubberley . | |
| 2,137,369 | 11/1938 | Terry | 211/120 |
| 2,279,643 | 4/1942 | Silver | 211/120 X |
| 2,522,416 | 9/1950 | Weiskopf | 211/120 X |
| 3,425,565 | 2/1969 | Sprenger | 211/43 |
| 3,844,415 | 10/1974 | Heimann | 211/43 |
| 3,850,303 | 11/1974 | Franklin | 211/134 |
| 4,801,022 | 1/1989 | Colby | 211/50 |
| 4,969,561 | 11/1990 | Yang | 211/59.2 |
| 5,121,681 | 6/1992 | Chang | 108/25 |
| 5,137,151 | 8/1992 | Choate | 206/370 |

*Primary Examiner*—Robert W. Gibson, Jr.
*Attorney, Agent, or Firm*—Rohm & Monsanto

[57] ABSTRACT

A self-adjusting storage rack for holding vertically stationery, envelopes, letters, file folders, cards, photos, magazines and similar flat surface articles. The device comprises of two upright ends mounted on a base of two flat telescopic rods; a third central telescopic rod acts as a guide for a elastic, expandable and continuous multi-coil; each end coil is attached to an upright end so that one upright may be manually pulled out, extending the length of the rack to the full length permitted by the telescopic rods or any length in between. The elastic coil between the two uprights adjust itself accordingly.

8 Claims, 7 Drawing Sheets

SELF-ADJUSTING STORAGE RACK

BACKGROUND OF THE INVENTION (a) Field of Invention

The present invention relates to a self-adjusting storage rack for holding in position stationery, envelopes, letters, file folders, cards, photos, magazines and similar flat articles.

(b) Description of Prior Art

U.S. Pat. No. 3,844,415 describes an adjustable rack without any separate supports between the articles so that the articles are placed together. U.S. Pat. No. 4,801,022 describes a rack that's not extendable and is of a fixed size; and within the limits of said rack, the vertical supports are not self-adjusting. The lower support rod for mail or similar articles requires a hole to be punched through the article, large enough to slide the article on a rod. Said rod must be pulled out on one side to slide punctured mail, etc. onto it.

My invention accepts all previously mentioned articles between the self-adjusting elastic supports, either individually or collectively. Such articles are easily inserted and removed. The rack itself may be manually lengthened to twice its size or any convenient size between the end-plates and the elastic supports self-adjust to the new length.

U.S. Pat. No. 1,750,576 has a rack which is adjustable and has rigid upright supports which must be placed in slots between the end-plates, such supports are obviously not self-adjusting and, not being flexible, maintain a fixed position so space between vertical supports does not conform to the size of article inserted or removed.

All storage racks have rigid vertical or horizontal supports in which articles filed are placed together or, if filed separately, leaves too much wasted space between the fixed vertical supports. Where articles are filed within the same vertical uprights, it is not easy to see or select one article without removing the others. This also holds true when files are placed horizontally one on top of the other in filing racks.

Present adjustable racks do not have flexible, multiple self adjusting vertical uprights for individually filing the previously mentioned articles nor do the retaining uprights automatically adjust for individual files when the end-plates are extended to lengthen the rack.

Most storage racks or desk top organizers appear bulky and even when not in use require the same amount of desk space whereas my device is small and compact in comparison and yet can hold numerous articles, providing easy accessibility with immediate insertion and removal of individual items.

In order to provide background information so that the invention may be completely understood and appreciated in its proper context, reference is made to a number of prior art patents and publications as follows;

| U.S. PATENT DOCUMENTS | | |
|---|---|---|
| 1682060 | 8/1928 | Banks 211/43 |
| 1739545 | 12/1929 | Cubberley 211/51X |
| 1750576 | 3/1930 | Cubberley 211/43X |
| 1772438 | 8/1930 | Cubberley 211/11 |
| 3425565 | 2/1969 | Sprenger 211/43 |
| 3844415 | 10/1974 | Heimann 211/43 |
| 3850303 | 11/1974 | Franklin 211/43 |
| 4801022 | 1/1989 | Colby 211/11 |
| 5121681 | 6/1992 | Chang 211/42 |

SUMMARY OF THE INVENTION

Object of this invention is to get away from the rigid fixed vertical supports of present storage racks or desk organizers.

Another object is to have an efficient, simpler and compact storage rack or desk organizer.

Another object is to have such flexibility and adaptability in vertical supports to allow easy individual insertion and removal of flat surface articles such as mail, filing cards, folders, etc.

Another object of this invention is to allow even multiple insertions between the elastic upright supports which will adapt to width of the article inserted, leaving no wasted space between supports.

Another object is to have an easily extendable storage rack with a self adjusting vertical support area that can hold numerous articles either singularly or collectively.

According to the above objects, the present invention provides a storage or desk organizer for incoming or out going mail, filing folders, reference cards, photos and any article of substantially two-dimensional shape. The elastic supports require no individual adjustment and will readily adapt to the size of article or articles inserted, leaving no unused space between such articles. The rack itself may be easily extended to double its size or any convenient size in between.

Other and further objects, advantages and features of the present invention will be understood by reference to the following specifications in conjunction with the annexed drawings wherein like parts have been given like numbers:

10 COIL
11 END-PLATE
12 PUNCH-OUT TAB
13 FEMALE FLAT TUBULAR ROD
14 MALE FLAT TUBULAR ROD
15 TOP FLAT SOLID SLIDING ROD
16 BOTTOM FLAT SOLID SLIDING ROD
17 PUNCH-OUT TAB STOP
18 FLANGE
19 FEMALE RAIL
20 MALE RAIL
21 SIDE OF FEMALE FLAT TUBULAR ROD
22 SIDE OF MALE FLAT TUBULAR ROD
23 ENTIRE FEMALE SECTION
24 ENTIRE MALE SECTION
25 INNER RIM OF FEMALE SECTION
26 INNER RIM OF MALE SECTION
27 END COIL OF ELASTIC COILS
28 TUBULAR HOLDER
29 TUBULAR BACK FEMALE ROD
30 TUBULAR BACK MALE ROD
31 ARTICLE INSERTS

DETAILED DESCRIPTION OF THE INVENTION

Figure 1:
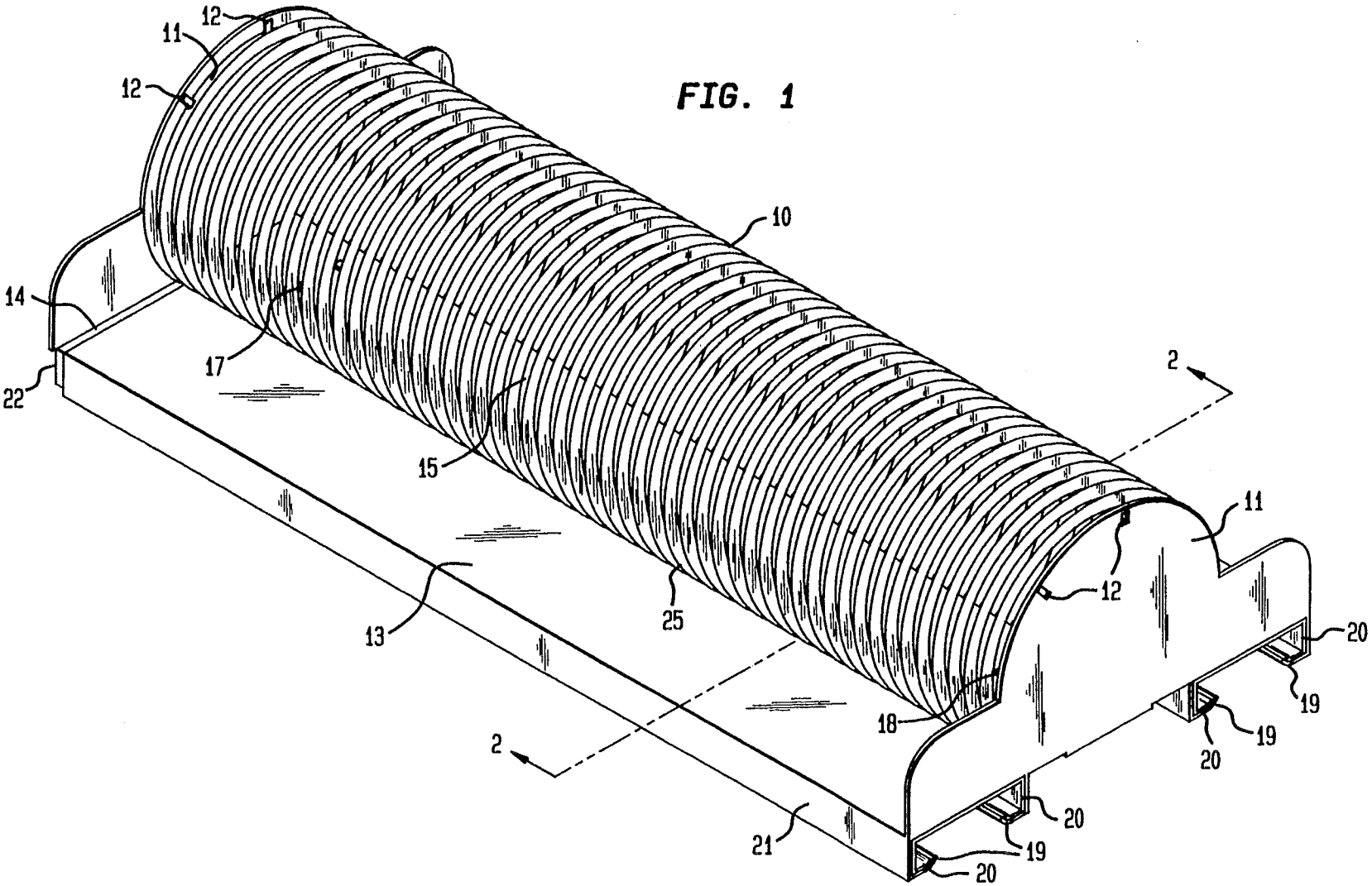
FIG. 1 is a perspective view of self-adjusting storage rack.
Figure 2:
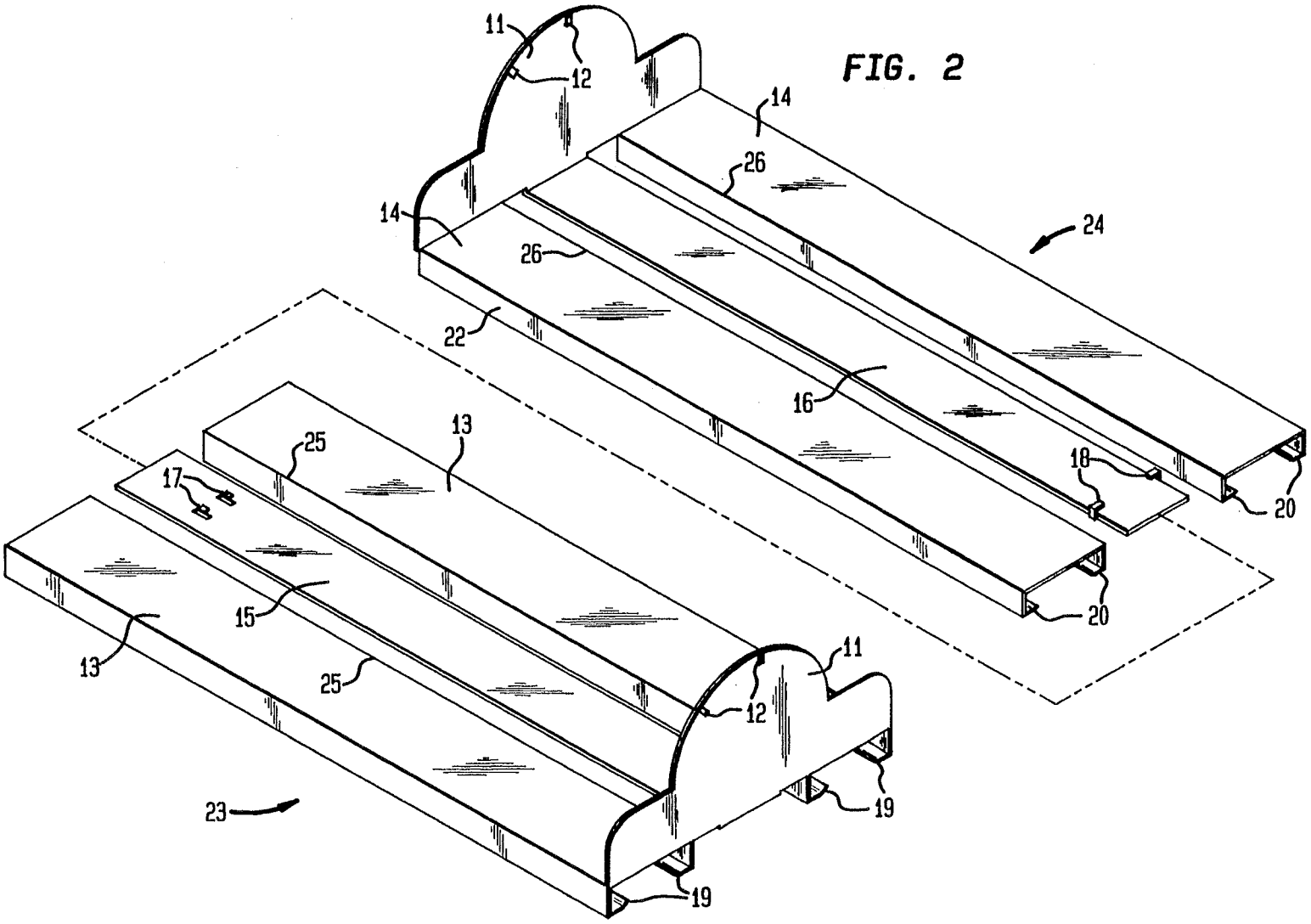
FIG. 2 shows the exploded two sections of support frame, male and female, without the coil attached to the end-plates.

Referring to FIG. 1 and FIG. 2, this device comprises three parts: the flexible, expandable, elastic coil 10 and the left and right male and female support sections, female section 11, 13 and 15, entire female section henceforth number 23, and the male section 11, 14 and 16, entire male section henceforth number 24. The female section 23 comprises a vertical end-plate 11, two outer flat tubular rods 13 and one inner top sliding flat solid rod 15. The male section 24 comprises a vertical end-plate 11, two outer flat tubular rods 14 that can be inserted into 13, completing the telescopic rod 13–14, and one inner bottom sliding flat solid rod 16 which slides beneath top sliding rod 15 to form complete center telescopic rod 15–16. Rod 16 is connected to rod 15 by its side flanges 18. Each section has a vertical plate 11 at 90 degree angle to its telescopic rods: one 15, two 13 for the female and one 16 and two 14 for the male. The coil 10 between end-plates 11 has its end coils 27 attached to inner side plate by the punch-out tabs 12. When section 24 is inserted into section 23 and said elastic coils attached to end plates, the elastic self-adjusting supports adjust themselves when the storage rack is manually expanded and shortened.

Figure 4:
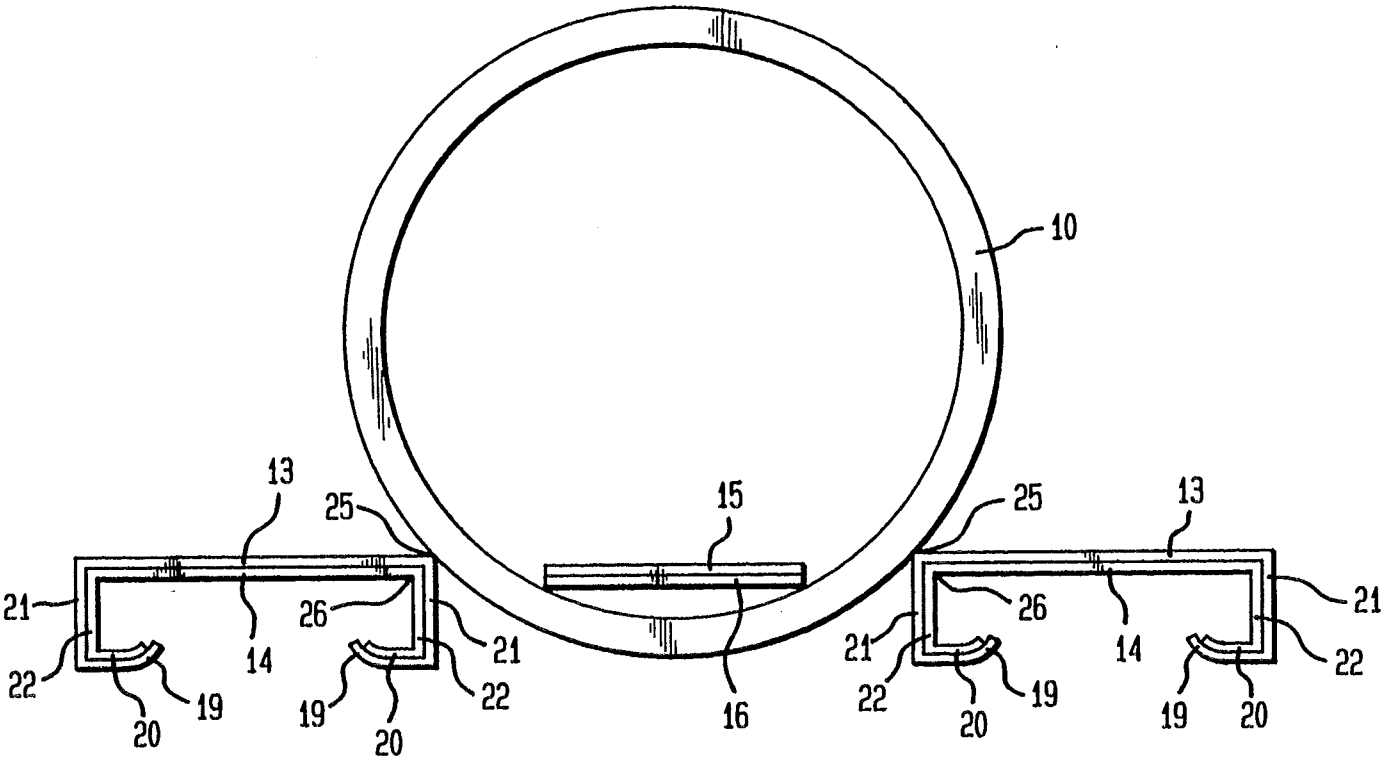
FIG. 4 is a transverse view, line 2—2 in FIG. 1, showing the coil's position in relationship to the three telescopic rods.

Referring to FIG. 4, the inner telescopic rod 15–16 runs through lower part of coil just above the bottom coils, keeping extended coil in center, preventing coil from moving upward and holding lower part of coil between the inner rims 25 and 26 when telescopic rods 13–14 are manually extended. As shown in FIG. 4, in this specific illustrative embodiment of the invention, telescopic rods 13–14, as well as telescopic rod 15–16, have flat coplanar tops which serve to support the articles in the manner shown in FIG. 5. The base female telescopic rods 13 have inner rails 19 which accept the inner male rails 20. The right angle sides of the female flat telescopic rods 21 extend downward at a 90 degree angle and are of such width as to prevent lower part of coil from touching the surface of the platform on which it is placed so coils can slide freely back and forth.

Figure 3:
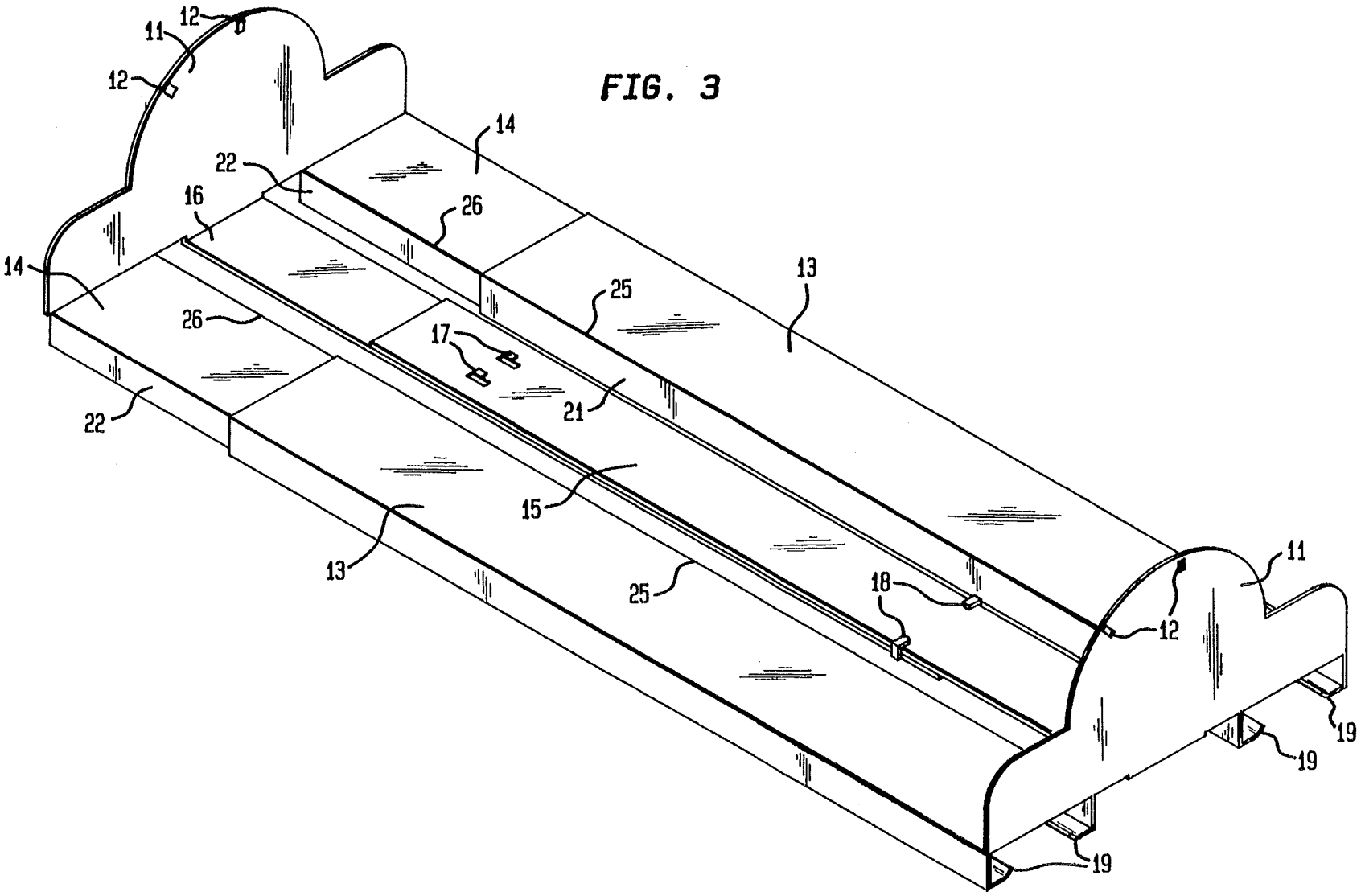
FIG. 3 is a perspective view of support rack, partly extended, without the coil, showing telescopic effect of male section in female section.

The assembled device is compact and suitable for placing on desk tops or any convenient flat surface. The telescopic rods even when extended will hold their position since the flexible, expandable, elastic coils 10 exert negligible tension between the end-plates 11. FIG. 3 shows the punch-out tab stops 17 on center rod 15 which will engage flanges 18 on center rod 16 and prevent sections from being pulled completely apart.

Figure 5:
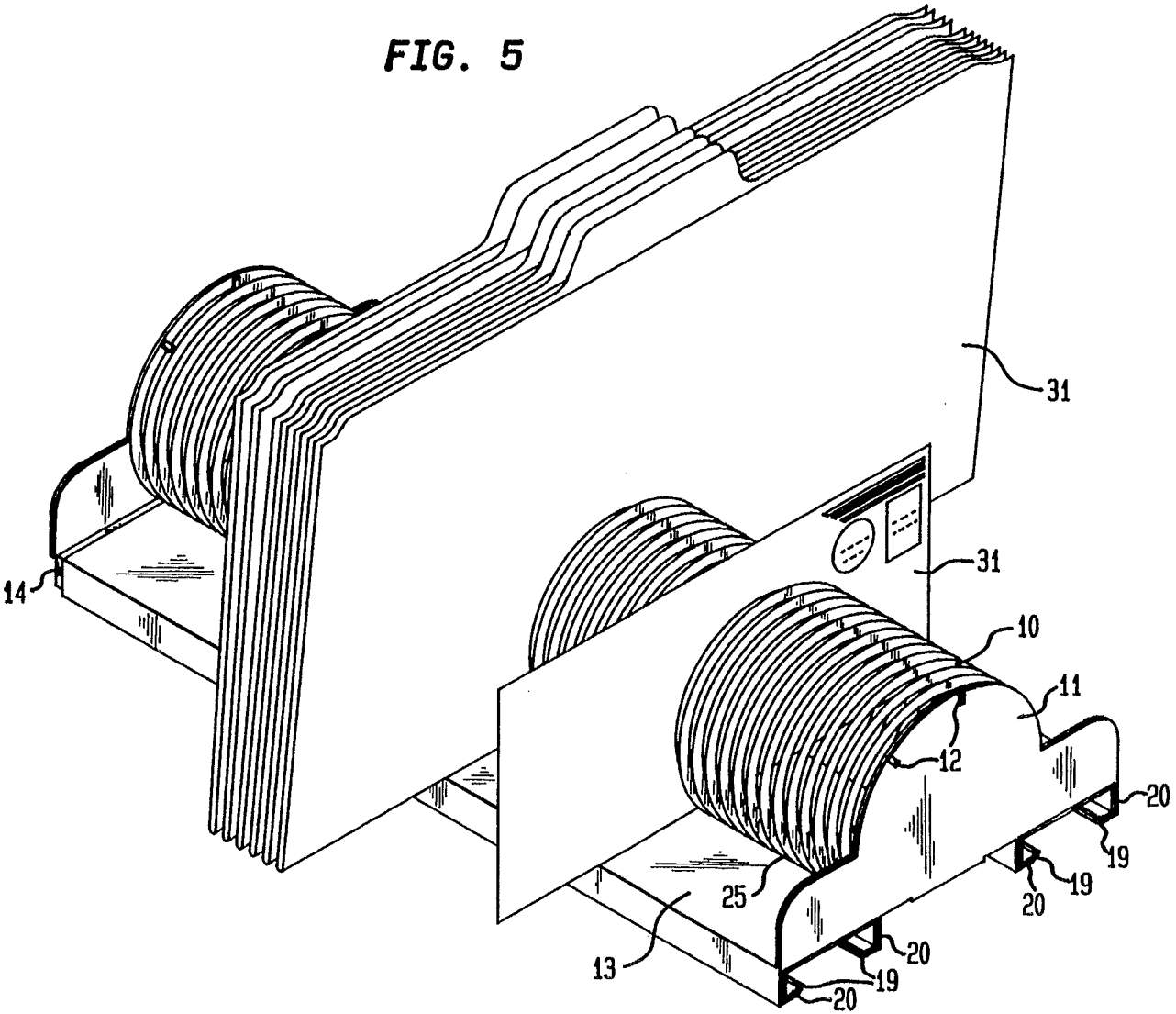
FIG. 5 shows assembled coil storage rack in use with several stored articles.

The coil spring 10 automatically will adjust itself to whatever length or size the device is set. The spacing between the elastic adjacent coils will hold vertically any of the aforementioned items or articles 31, such articles being easily inserted or removed and each occupying an individual space between adjacent coils. Even where numerous articles are placed between two coils, the other coils are not affected in their functioning capacity as shown in FIG. 5.

Figure 6:
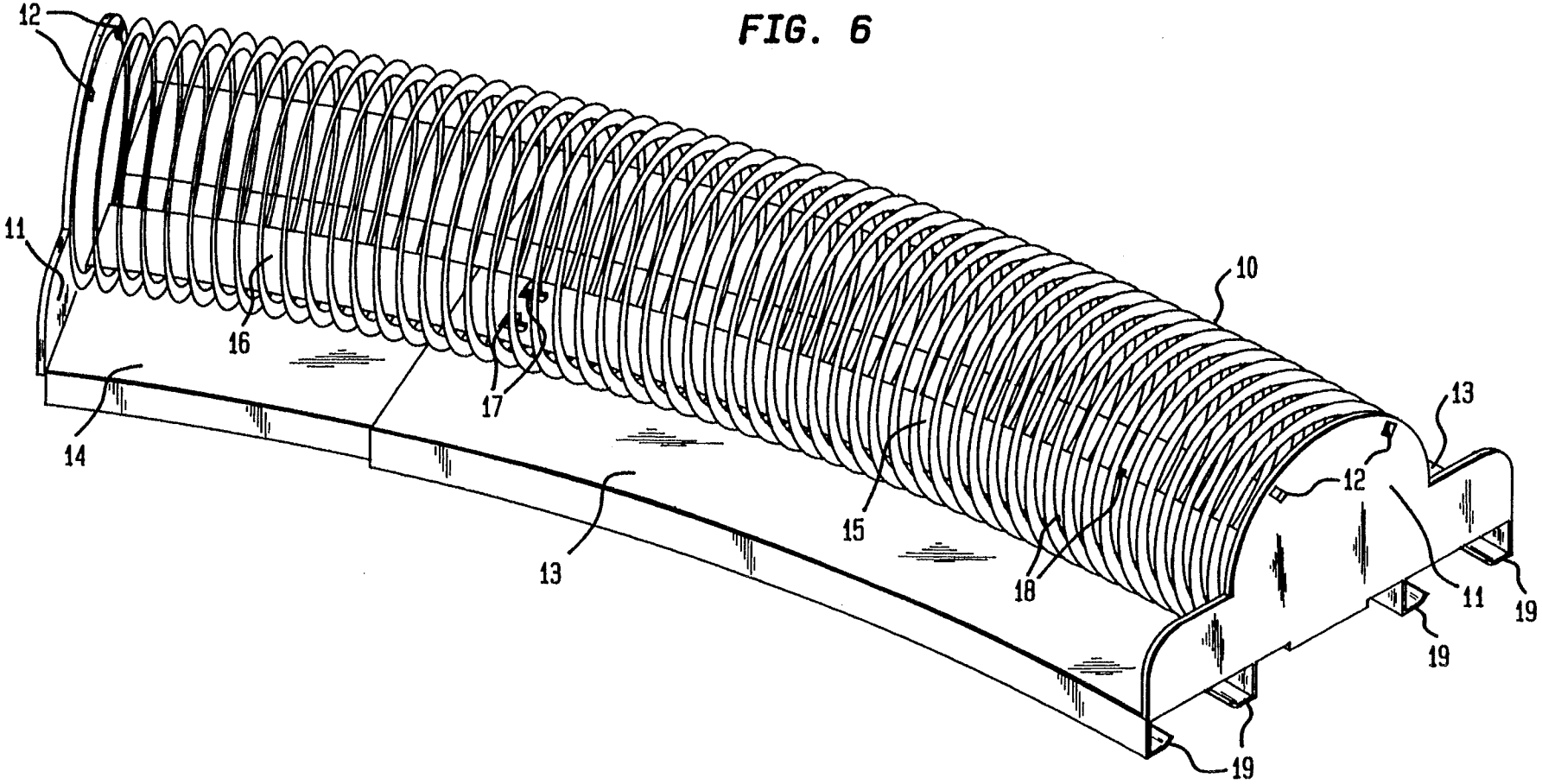
FIG. 6 is a prospective view of a curved adjustable storage rack partly extended.

The simplest version of this device would be a none expandable rack comprising two end-plates, a base and the elastic coil. The device's length and the coil's diameter may be of any convenient size to place on top of a desk or any other chosen flat surface. The material of the rack may be composed of metal, plastic or wood or any suitable material. The support rack 13, 14, 15 and 16 which is straight may also be designed with a curve or arc as shown in FIG. 6.

Figure 7:
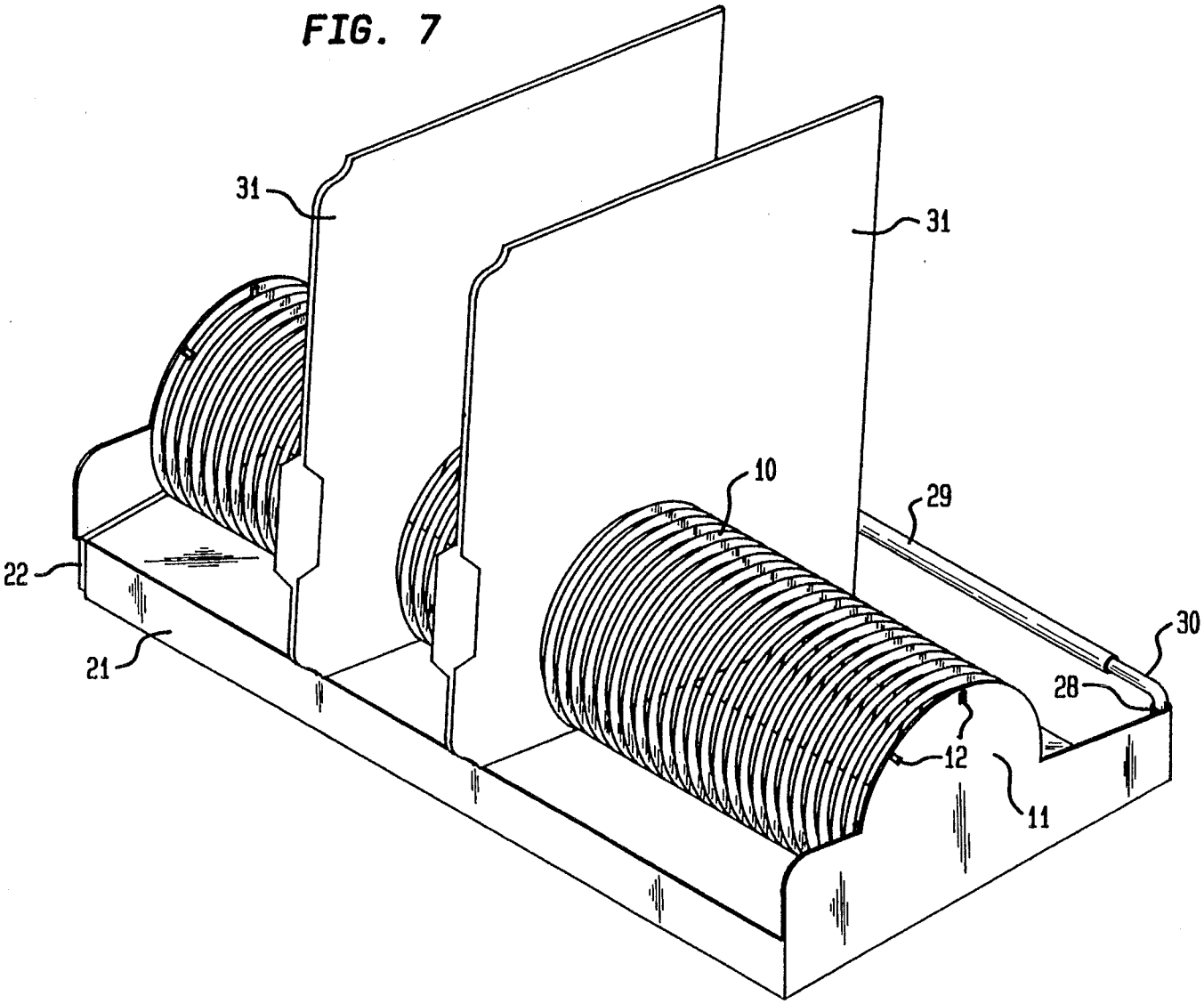
FIG. 7 is a perspective view of a tilted adjustable storage rack with several articles inserted.

Also, the base of rack may be tilted at a suitable angle by having the front perpendicular sides of 21–22 wider than the back perpendicular sides 21–22. Back side has a telescopic rod comprising a tubular back female rod 29 and a back male rod 30, the ends of which bend at a 90 degree angle to fit into the tubular holders 28 and prevent articles from sliding backward as shown in FIG. 7.

What I claim is:

1. A self-adjusting storage rack for at least one article, the self-adjusting storage rack being of the type having a continuous resilient spiral element having first and second ends, a plurality of coaxial windings therebetween, the plurality of coaxial windings defining an interior axial region, wherein axially adjacent ones of the coaxial windings communicate with the article, the self-adjusting storage rack further comprising:

a first support portion formed of a sheet material, said first support portion having a respective end plate coupled to the first end of the continuous resilient spiral element, said first support portion further having first, second, and third elongated members; and a second support portion formed of said sheet material, said second support portion having a respective end plate coupled to the second end of the continuous resilient spiral element, said second support portion having respective first, second, and third elongated members, said first and third elongated members of said first support portion being telescopically engaged with said first and third elongated members of said second support portion, said respectively engaged first and third support portions having respective fiat, coplanar upper surfaces disposed outside of the plurality of coaxial windings for forming a coplanar support for the article.

2. The self-adjusting storage rack of claim 1, wherein said second elongated members of said first and second support portions are disposed within the axial region and engage with one another to form a stop which determines the maximum telescopic extent of the first and second support portions with respect to each other.

3. The self-adjusting storage rack of claim 1, wherein said second elongated members of said first and second support portions are arranged to be substantiality flat and coplanar with said coplanar support for the article.

4. The self-adjusting storage rack of claim 1, wherein at least one of said first and third elongated members of one of said first and second support portions is arranged to overlie one of said first and third elongated members of the other support portion, and engage therewith from underneath.

5. The self-adjusting storage rack of claim 1, wherein said sheet material is a metal.

6. A self-adjusting storage rack for at least one article, the self-adjusting storage rack being of the type having a continuous resilient spiral element having first and second ends, a plurality of coaxial windings therebetween, the plurality of coaxial windings defining an interior axial region, wherein axially adjacent ones of the coaxial windings communicate with the article, the self-adjusting storage rack further comprising:

first and second extendable platform members arranged to be substantially parallel with the exterior of the continuous resilient spiral element, each of said first and second extendable platform members being foraged of a pair of telescopically engaged slidable submembers, said first and second extendable platform members each having a flat upper surface for supporting the article, said upper surfaces being coplanar; and first and second coupler means arranged at respective ends of said first and second extendable platform members for coupling a slidable submember of said first extendable platform member to a slidable submember of said second extendable platform member, and to a respective one of said first and second ends of the continuous resilient spiral element.

7. The self-adjusting storage rack of claim 6, wherein each of said first and second coupler means is provided with an extendable limit stop portion which defines a maximum separation of said first and second coupler means.

8. The self-adjusting storage rack of claim 7, wherein said extendable limit stop portions are arranged to be substantially coplanar with said first and second extendable platform members, and disposed within the continuous resilient spiral element.

* * * * *